US009767684B2

(12) United States Patent
Lim et al.

(10) Patent No.: US 9,767,684 B2
(45) Date of Patent: Sep. 19, 2017

(54) METHOD AND DEVICE FOR CONTROLLING DEVICE USING BLUETOOTH IN WIRELESS COMMUNICATION SYSTEM

(71) Applicant: LG ELECTRONICS INC., Seoul (KR)

(72) Inventors: Jinkwon Lim, Seoul (KR); Younghwan Kwon, Seoul (KR); Jingu Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/282,819

(22) Filed: Sep. 30, 2016

(65) Prior Publication Data

US 2017/0154522 A1 Jun. 1, 2017

Related U.S. Application Data

(60) Provisional application No. 62/236,160, filed on Oct. 2, 2015, provisional application No. 62/242,316, filed on Oct. 16, 2015.

(51) Int. Cl.
*G08C 17/02* (2006.01)

(52) U.S. Cl.
CPC ..... *G08C 17/02* (2013.01); *G08C 2201/50* (2013.01); *G08C 2201/60* (2013.01)

(58) Field of Classification Search
CPC ..... G08C 17/02; G08C 23/04; G08C 17/00; G08C 19/28; G08C 2201/20; G08C 23/02; G08C 2201/21; G08C 2201/32; G08C 2201/92
USPC ..... 340/12.5
See application file for complete search history.

(56) References Cited

U.S. PATENT DOCUMENTS 7,546,956 B2 * 6/2009 Adams ..... G06F 12/1458 235/462.45
7,689,510 B2 * 3/2010 Lamkin ..... G06F 17/30041 705/51
7,886,033 B2 * 2/2011 Hopmann ..... H04L 12/2807 370/401
9,131,356 B2 * 9/2015 Heredia ..... H04L 12/5895
2016/0360345 A1 * 12/2016 Kim ..... H04W 8/005

* cited by examiner

*Primary Examiner* — Mark Blouin
(74) *Attorney, Agent, or Firm* — Lee, Hong, Degerman, Kang & Waimey

(57) ABSTRACT

The present invention relates to a method for a first device being controlled by a control device using a Bluetooth Lowe Energy (LE). The present invention provides a method and apparatus including establishing a Bluetooth LE connection with the control device; receiving a write request message requesting a specific operation with the second device from the control device; transmitting a write response message in response to the request message; transmitting a request message to the second device in order to perform the specific operation; and transmitting an error message indicating that a performance of the specific operation is failed to the control device, when failing to perform the specific operation with the second device within a specific time, where the request message includes time information indicating the specific time.

10 Claims, 18 Drawing Sheets

[Fig.1]
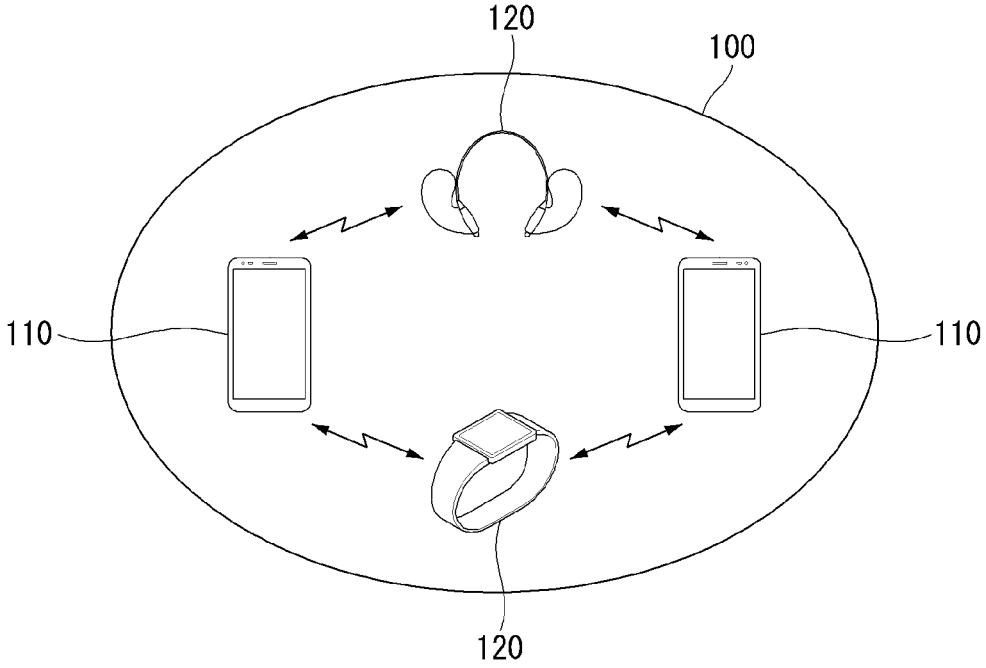

[Fig.2]
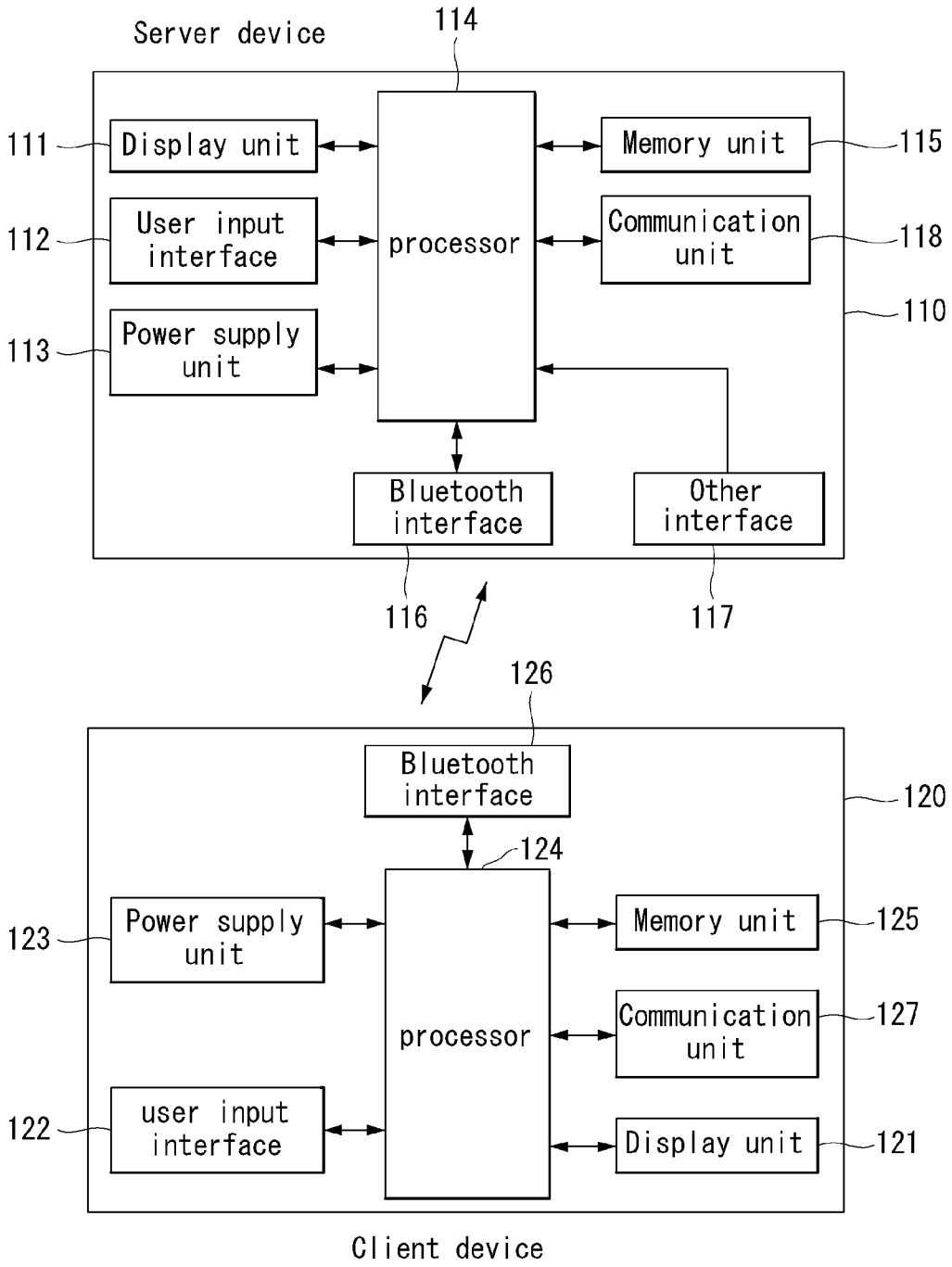

[Fig.3]
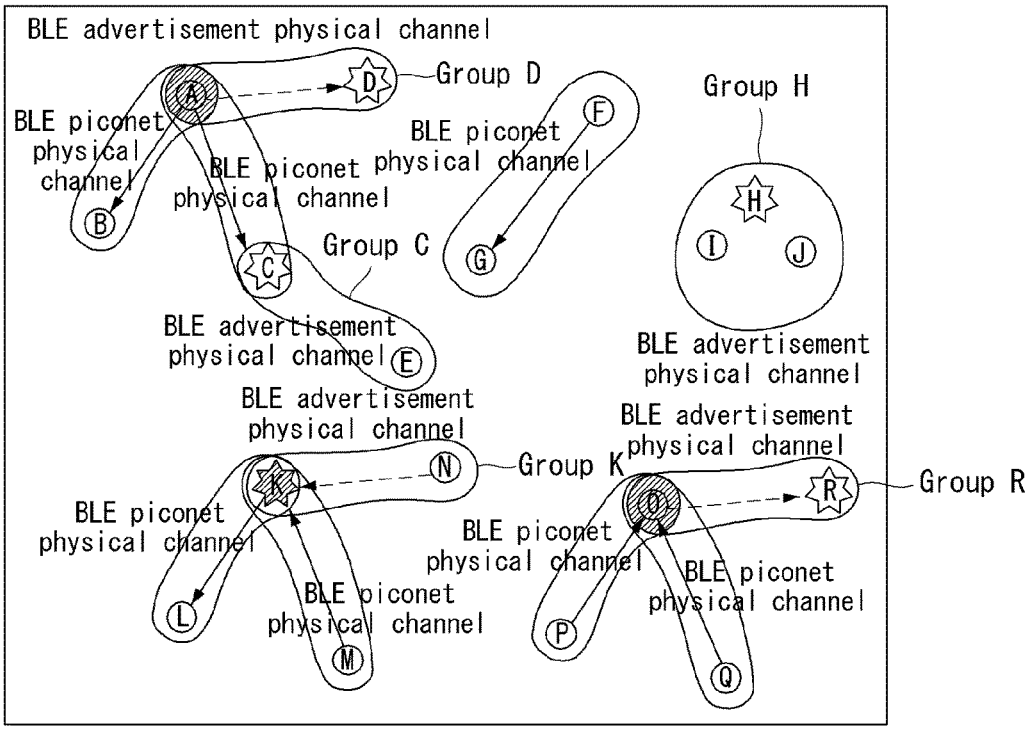

[Fig.4]
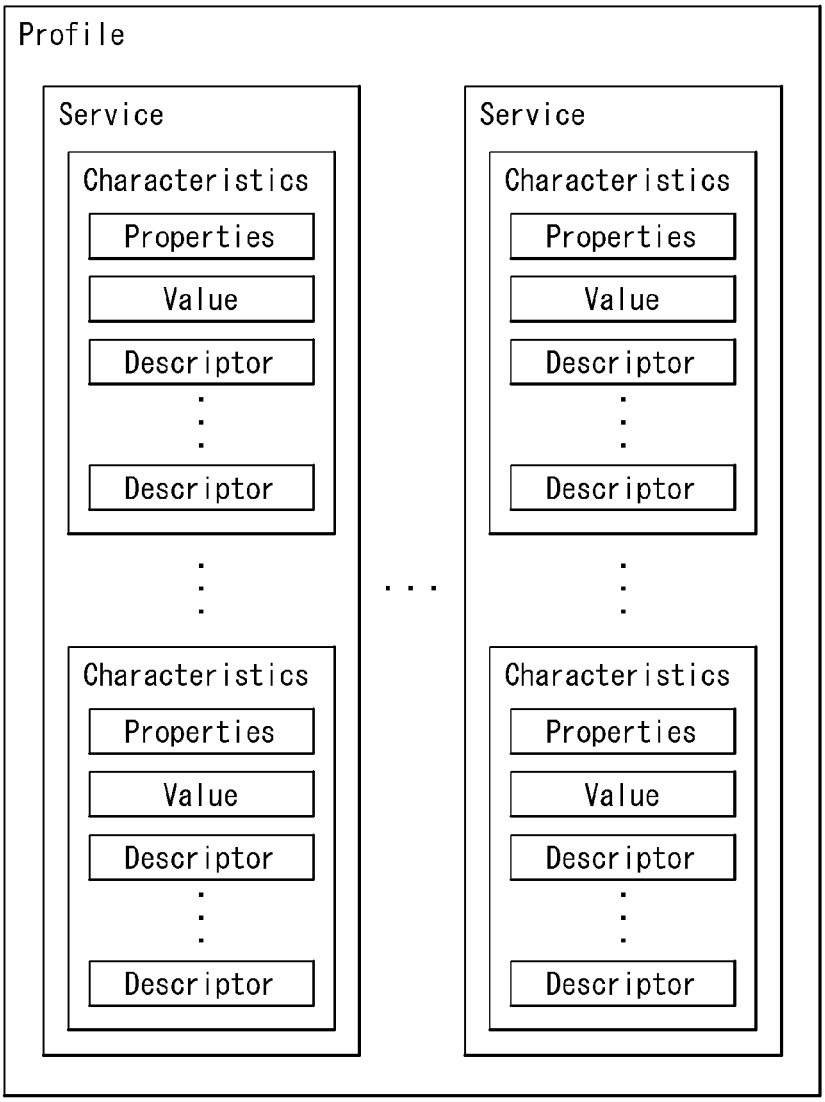

[Fig.5]
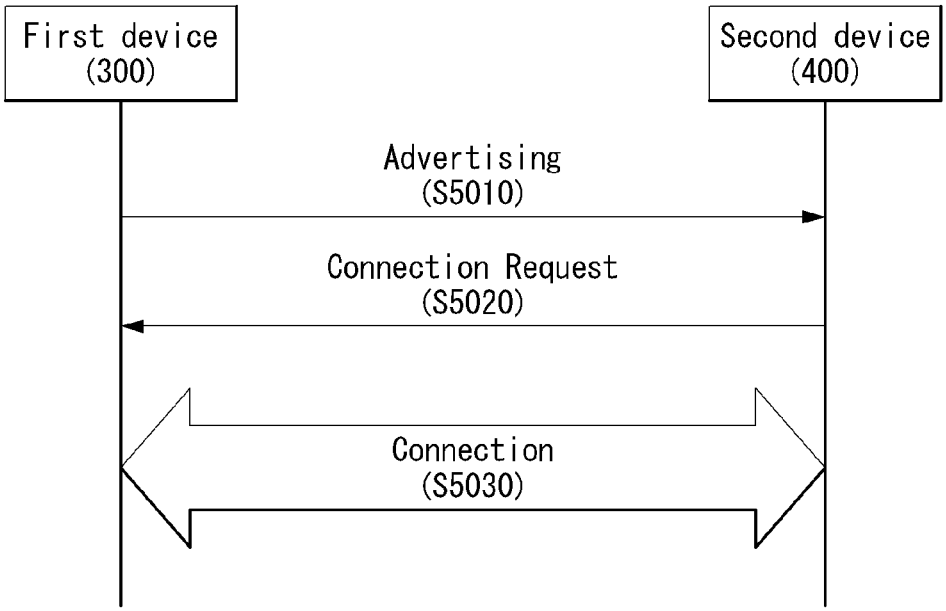

[Fig.6]
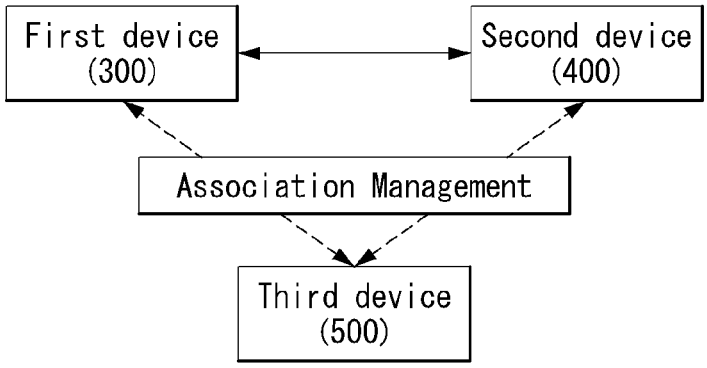

[Fig.7]
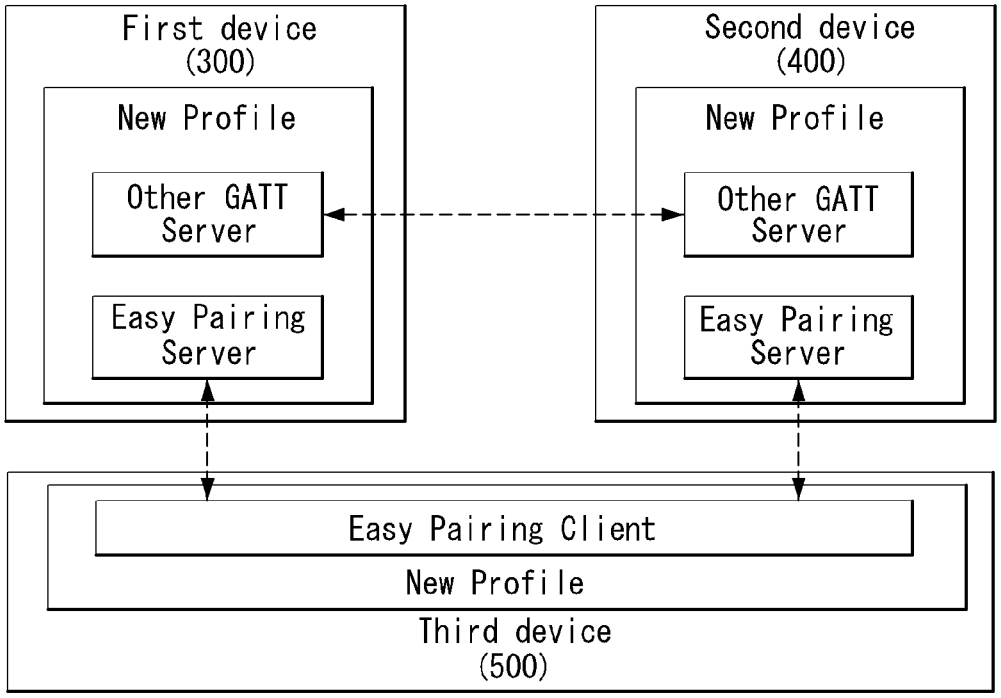

[Fig.8]
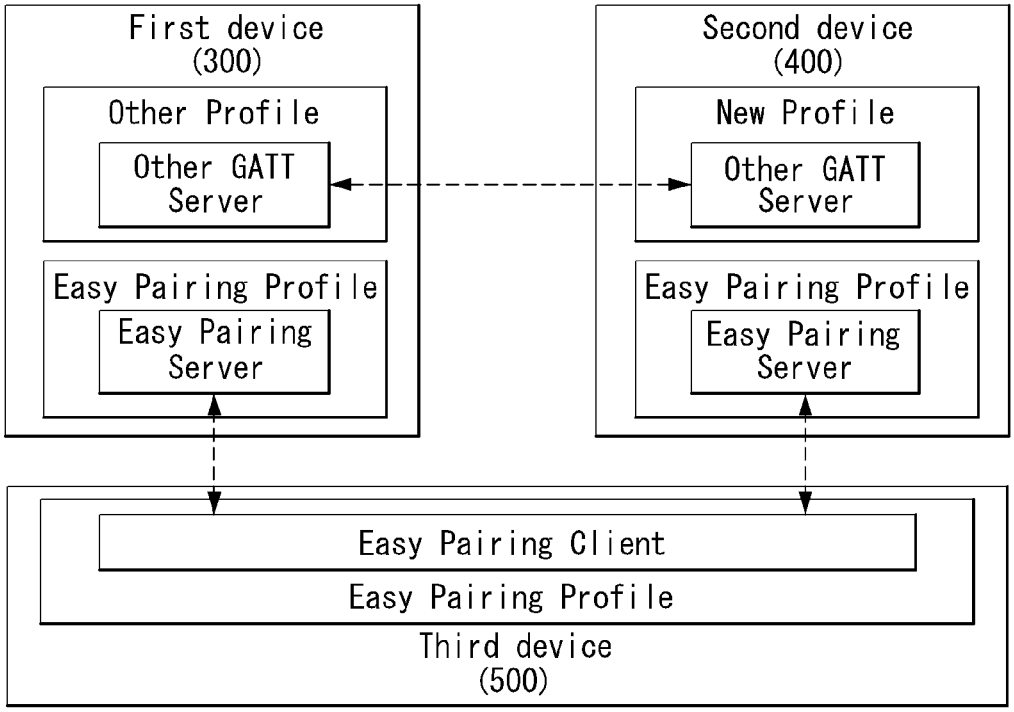

[Fig.9]
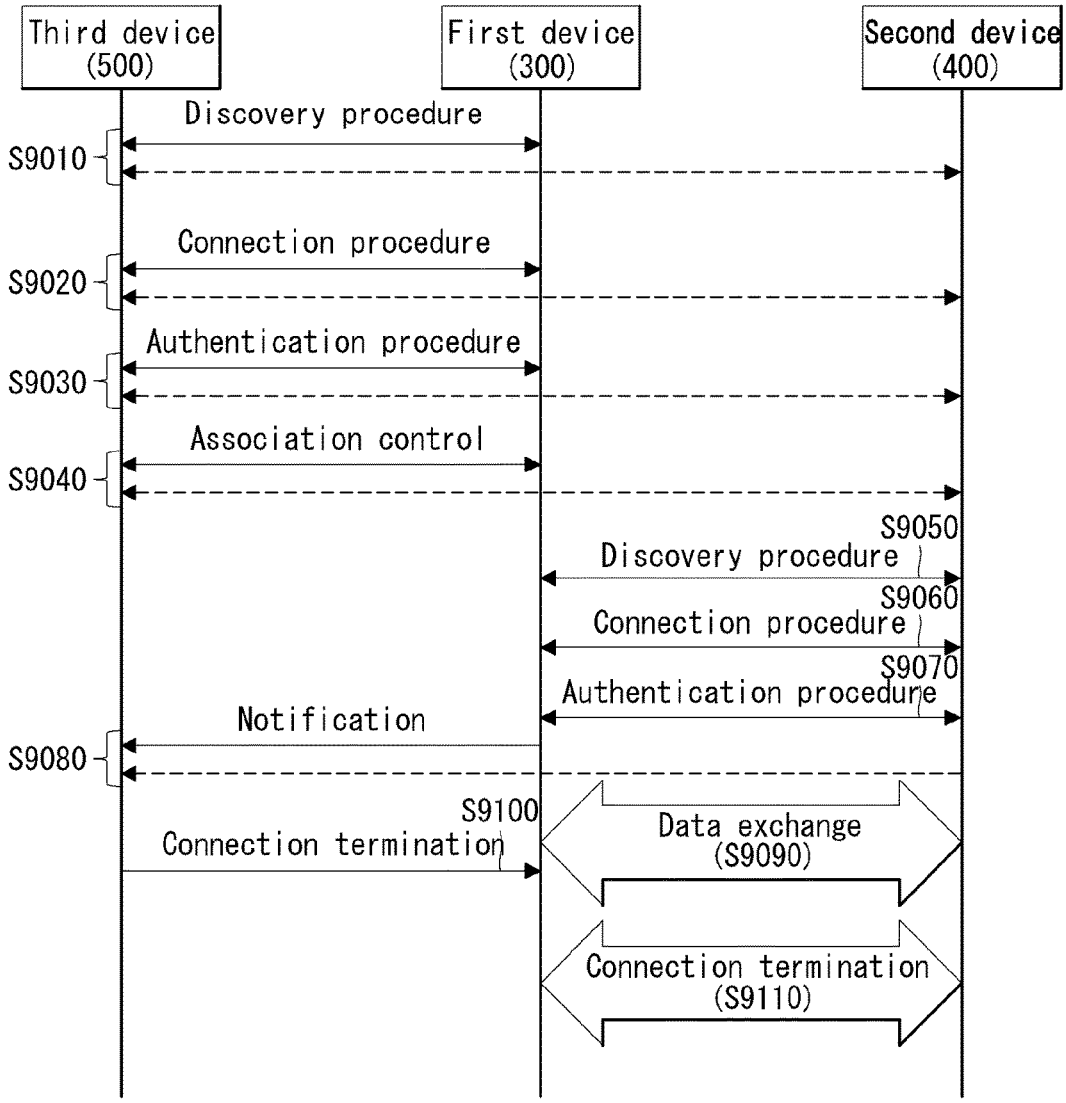

[Fig.10]
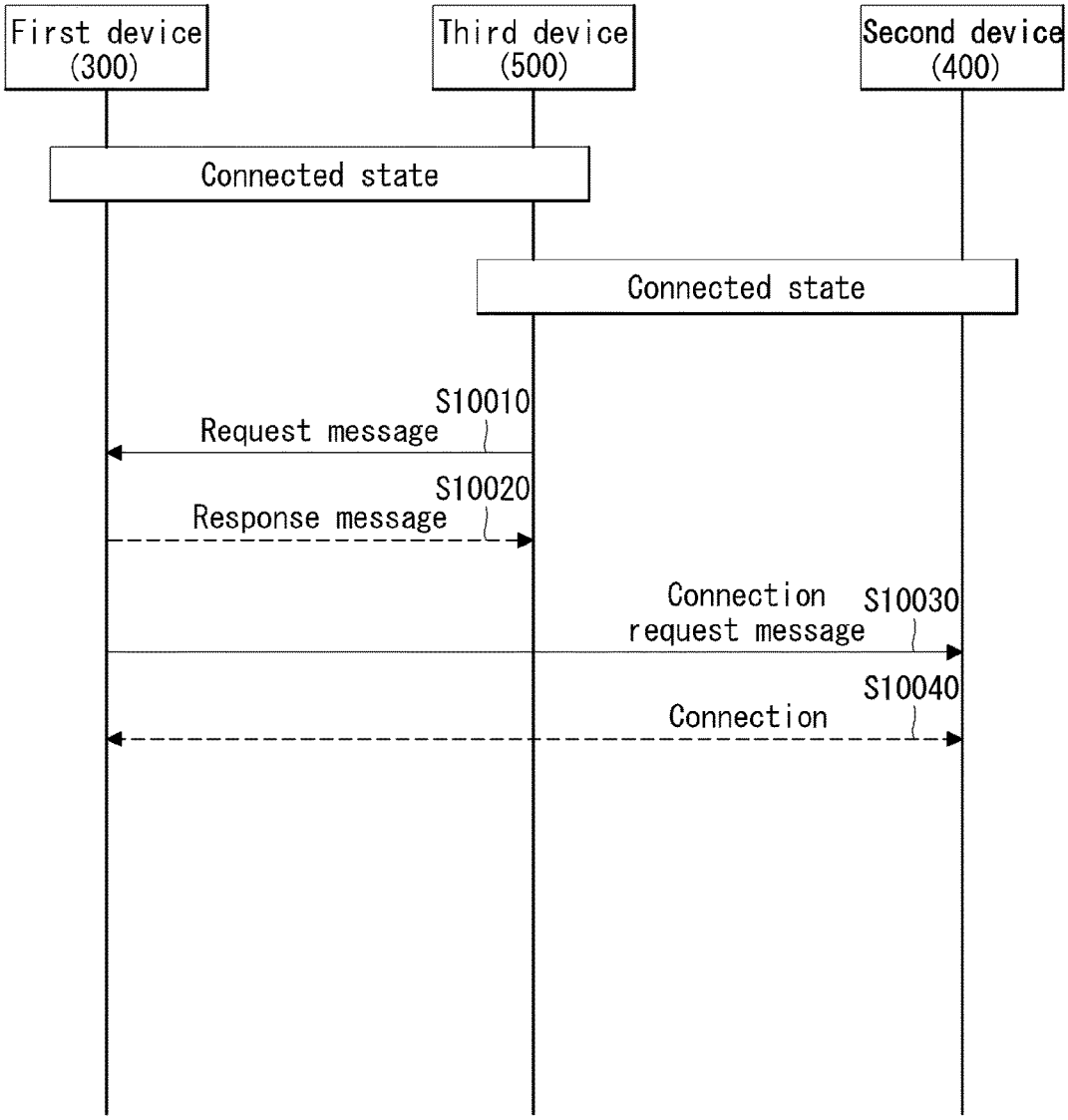

[Fig.11]
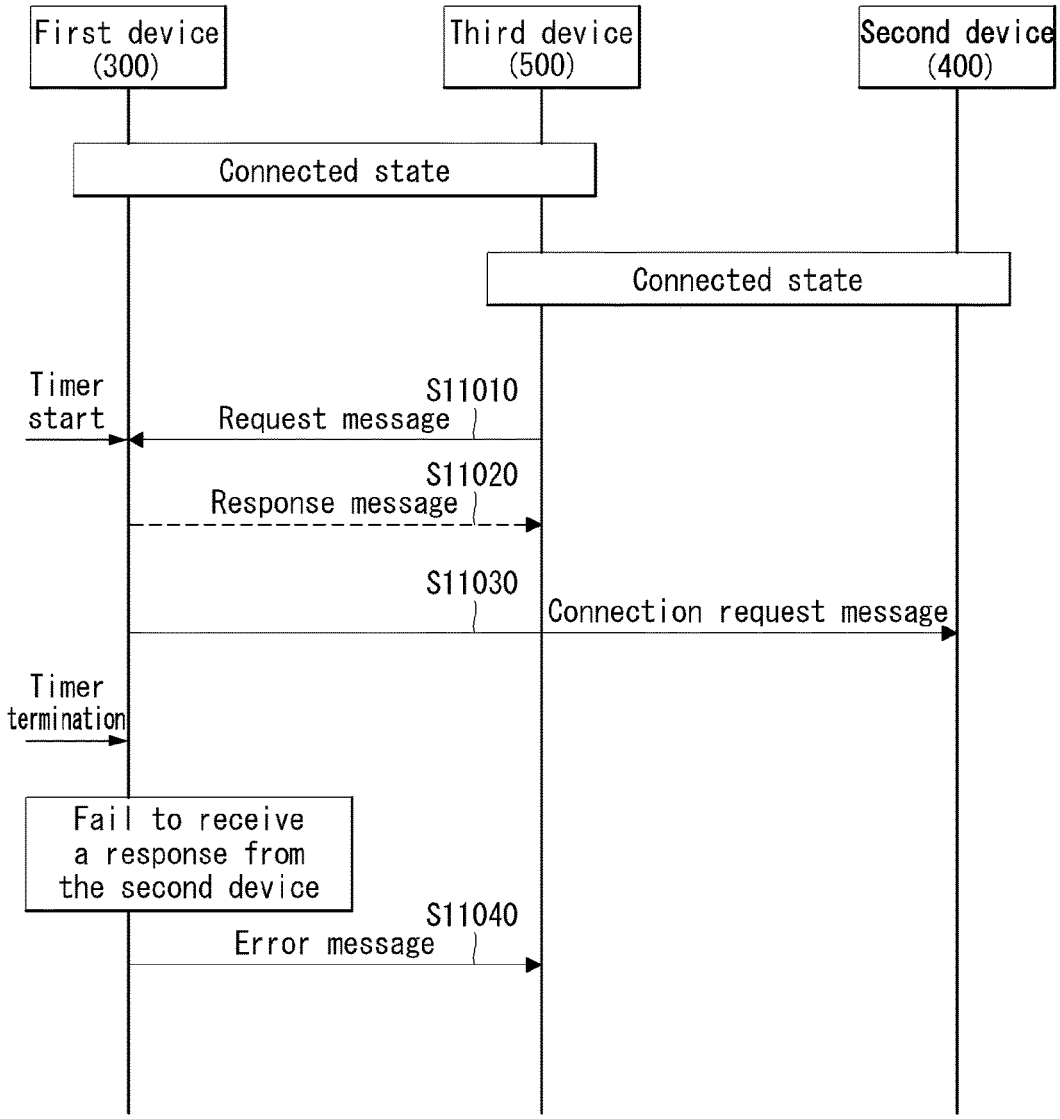

[Fig.12]

| Attribute Handle (2 byte) |
|---|
| Attribute Type (2 byte or 16byte) |
| Attribute Value (Fixed or Variable length) |
| Attribute Permissions (Established by GATT Profile) |

| Type | Data |
|---|---|

| Type | Type Name | Data |
|---|---|---|
| 0x01 | Timeout | 3s |
| 0x02 | Target Address | 5A:0B |
| 0x03 | ··· | ··· |

(a) Connection request message

| Attribute Handle (2 byte) |
|---|
| Attribute Type (2 byte or 16byte) |
| Attribute Value (Fixed or Variable length) |
| Attribute Permissions (Established by GATT Profile) |

| Type | Data |
|---|---|

| Type | Type Name | Data |
|---|---|---|
| 0x01 | Easy Pair Error | No Response |
| 0x02 | Easy Pair Error | Host Busy Pairing |
| 0x03 | Easy Pair Error | Key Mismatching |
| 0x04 | Easy Pair Error | Not Allowed |
| 0x05 | Easy Pair Error | ··· |
| 0x06 | Easy Pair Error | ··· |

(b) Error message

[Fig.13]
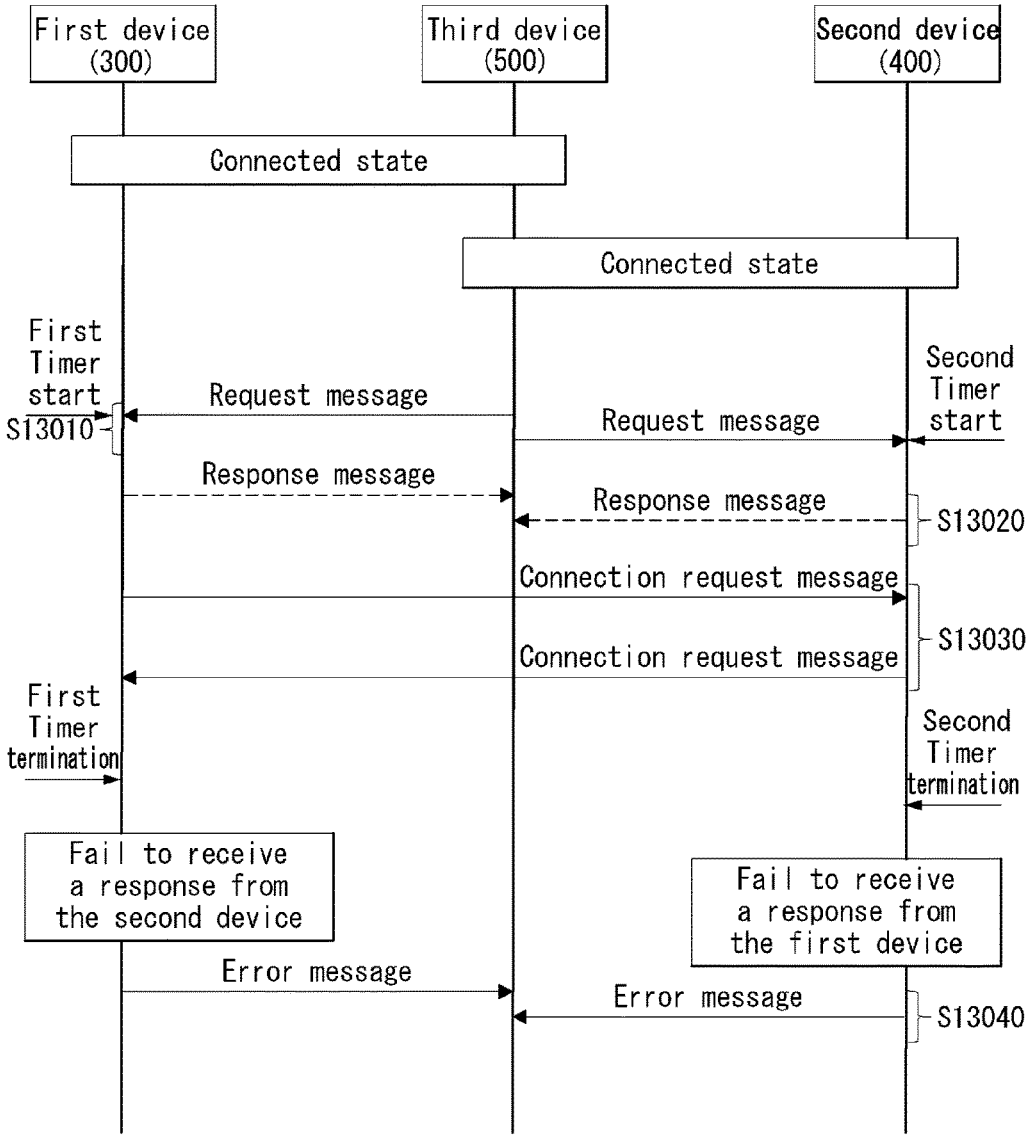

[Fig.14]
(a)
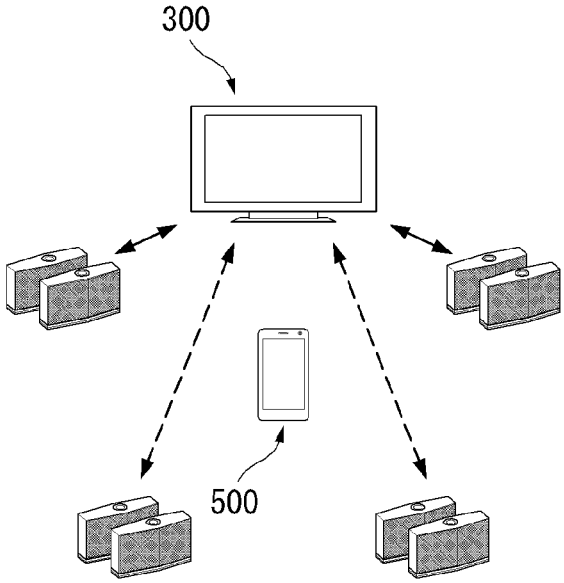
(b)
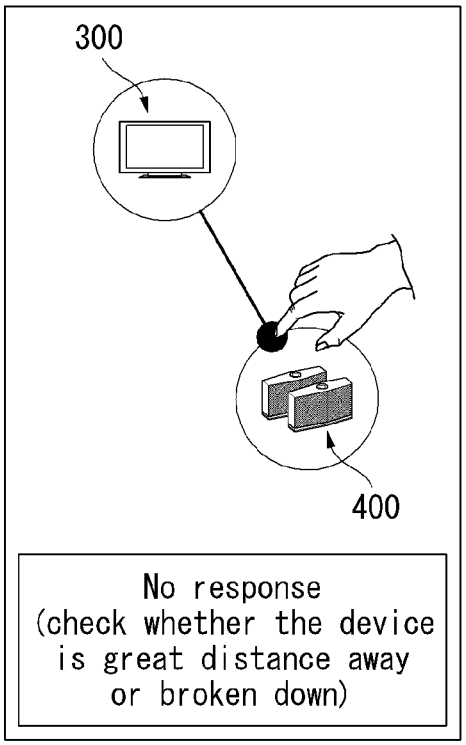

[Fig.15]
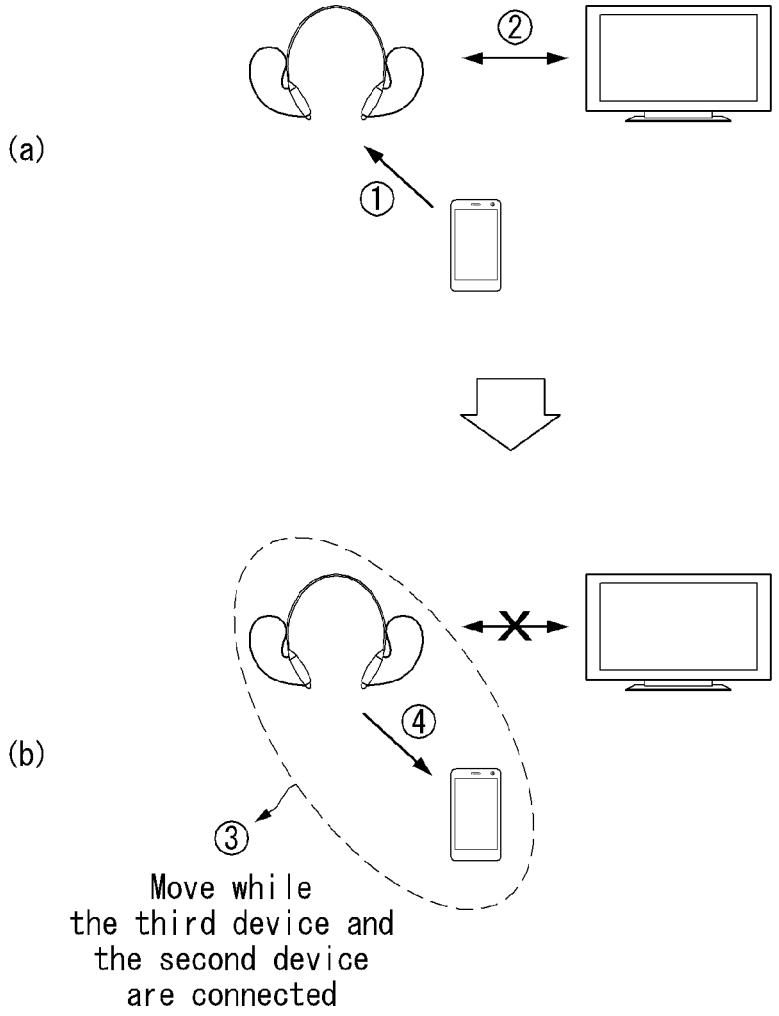

[Fig.16]
(a)
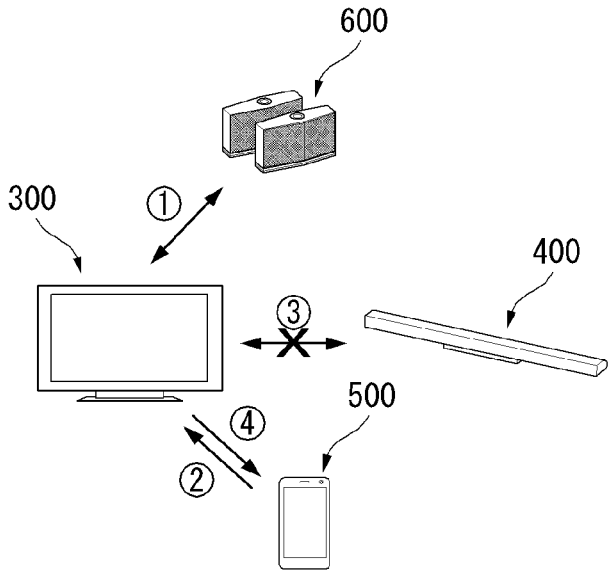
(b)
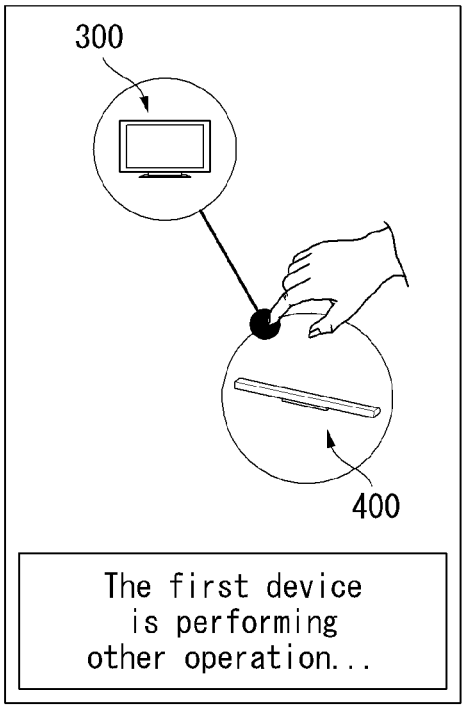

[Fig.17]
(a)
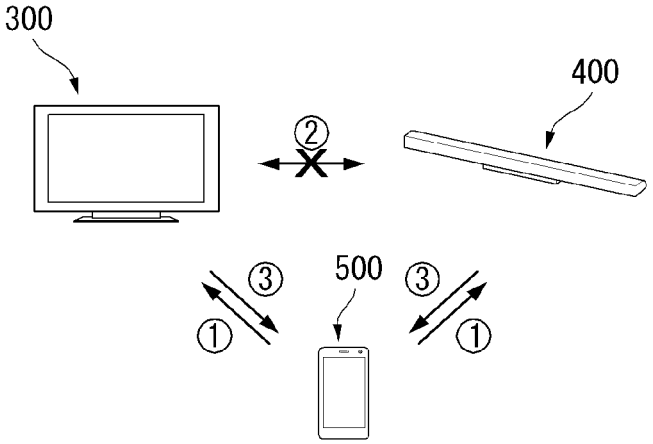
(b)
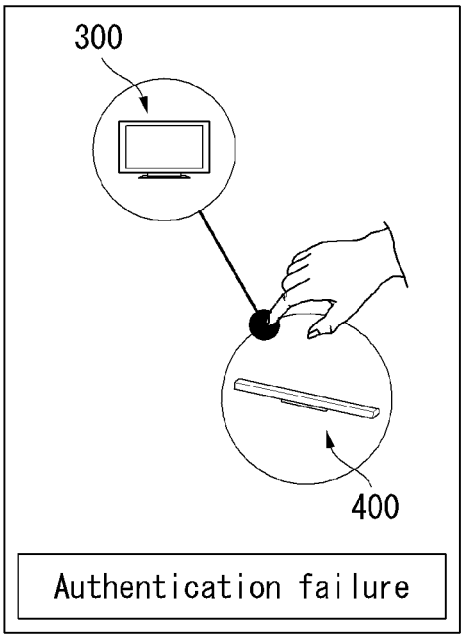

[Fig.18]
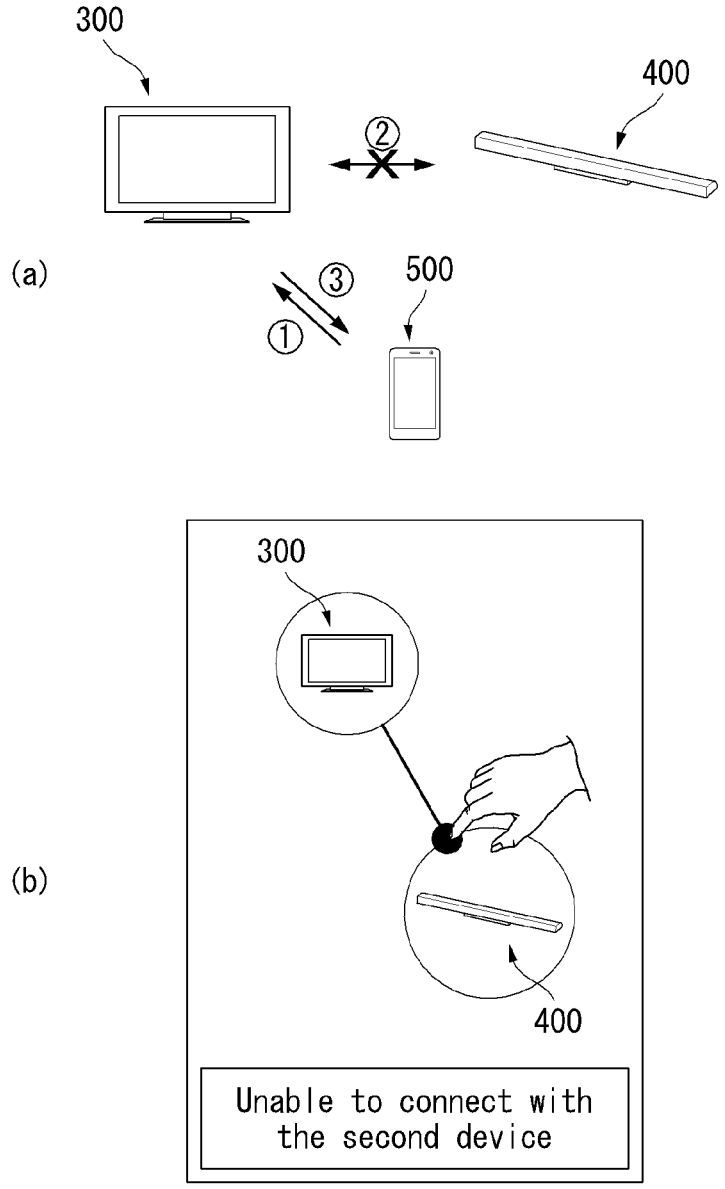

METHOD AND DEVICE FOR CONTROLLING DEVICE USING BLUETOOTH IN WIRELESS COMMUNICATION SYSTEM

CROSS-REFERENCE TO RELATED APPLICATIONS

Pursuant to 35 U. S. C. §119(e), this application claims benefit of U.S. Provisional Patent Application Nos. 62/236,160, filed on Oct. 2, 2015 and 62/242,316, filed on Oct. 16, 2015, the contents of which are all hereby incorporated reference herein in their entirety.

BACKGROUND OF THE INVENTION

Field of the Invention

The present invention relates to a method and apparatus for forming a connection between devices using the Bluetooth which is a short distance technique in wireless communication systems, and more particularly, to a method and apparatus for notifying an error that is occurred when forming a connection between devices using the Bluetooth technique.

Discussion of the Related Art

Bluetooth is an NFC technology standard allowing various devices to be wirelessly connected in a near field to exchange data. In a case in which two devices intend to perform wireless communication using Bluetooth communication, a user may perform a procedure for discovering a Bluetooth device with which he or she wants to communicate and requesting a connection. In the present disclosure, a device may refer to an apparatus or an appliance.

Here, the user may discover a Bluetooth device according to a Bluetooth communication method intended to be used using the Bluetooth device, and subsequently perform a connection.

The Bluetooth communication method may be classified as a BR/EDR method and an LE method. The BR/EDR method may be termed Bluetooth Classic. The Bluetooth Classic method includes a Bluetooth technology led from Bluetooth 1.0 and a Bluetooth technology using an enhanced data rate (EDR) supported by Bluetooth 2.0 or a subsequent version.

A Bluetooth low energy (LE) technology applied, starting from Bluetooth 4.0, may stably provide information of hundreds of kilobytes (KB) at low power consumption. Such a Bluetooth low energy technology allows devices to exchange information with each other by utilizing an attribute protocol. The Bluetooth LE method may reduce energy consumption by reducing overhead of a header and simplifying an operation.

Among the Bluetooth devices, some products do not have a display or a user interface. Complexity of connection, management, control, and disconnection among various types of Bluetooth devices and Bluetooth device employing similar technologies has increased.

Bluetooth supports a high speed at relatively low power consumption and at relatively low cost. However, since a transmission distance thereof is 100 m at the maximum, and thus, Bluetooth is appropriately used within a limited space.

SUMMARY OF THE INVENTION

An object of the present invention is to provide a method and apparatus for controlling a device using the Bluetooth technique.

In addition, another object of the present invention is to provide a method and apparatus for controlling an operation of a device by a control device using the Bluetooth technique.

In addition, still another object of the present invention is to provide a method and apparatus for transmitting an error which is occurred to a control device when the control device controls the operation of a device using the Bluetooth technique.

In addition, still another object of the present invention is to provide a method and apparatus for outputting a particular error which is occurred when a control device controls an operation of a device.

In addition, still another object of the present invention is to provide a method and apparatus for shortening the time consumed for checking an error which is occurred when a control device controls an operation of a device.

The technical objects to attain in the present invention are not limited to the above-described technical objects and other technical objects which are not described herein will become apparent to those skilled in the art from the following description.

According to an aspect of the present invention, a method for a control device to control a first device and a second device using a Bluetooth technique is provided.

Particularly, the method includes establishing a Bluetooth LE connection with the control device; receiving a write request message requesting a specific operation with the second device from the control device; transmitting a write response message in response to the request message; transmitting a request message to the second device in order to perform the specific operation; and transmitting an error message indicating that a performance of the specific operation is failed to the control device, when failing to perform the specific operation with the second device within a specific time, where the request message includes time information indicating the specific time.

In addition, in the present invention, the error message includes reason information indicating the cause of the failure of performing the specific operation.

In addition, in the present invention, the reason information indicates one of a failure to receive a response to the request message message, an encryption key mismatch, the first device performing another operation, or the second device not being an acceptable device.

In addition, in the present invention, the specific operation is establishing the Bluetooth LE connection with the second device.

In addition, in the present invention, the step of establishing the Bluetooth LE connection with the control device further comprises: transmitting an advertising message to the control device; and receiving a connection request message for the Bluetooth LE connection from the control device.

In addition, the present invention provide a method including: establishing a Bluetooth LE connection with at least one of the first device or a second device; receiving a write request message requesting a specific operation with at least one of the first device or the second device; receiving a write response message in response to the request message; receiving a message indicating a performance result of the specific operation within a specific time from at least one of the first device or the second device; and outputting the performance result of the specific operation.

In addition, in the present invention, the message further includes reason information indicating a failure reason, when failing to perform the specific operation.

In addition, in the present invention, the step of outputting the performance result includes outputting the failure reason together with the performance result.

In addition, in the present invention, the error reason indicates one of a failure to receive a response to the request message, an encryption key mismatch, performing another operation, or target device not being an acceptable device.

In addition, the present invention provide a device including a communication unit for communicating with external devices in wireless or wired manner; and a processor functionally connected to the communication unit, wherein the processor is configured to: establishing a Bluetooth LE connection with the control device; receiving a write request message requesting a specific operation with a second device from the control device; transmitting a write response message in response to the request message; transmitting a request message to the second device in order to perform the specific operation; and transmitting an error message indicating that a performance of the specific operation is failed to the control device, when failing to perform the specific operation with the second device within a specific time, where the request message includes time information indicating the specific time.

BRIEF DESCRIPTION OF THE DRAWINGS

FIG. 1 is a schematic view illustrating an example of a wireless communication system using a Bluetooth low energy technology to which the present invention is applicable.

FIG. 2 is an example of an internal block diagram of a device in which the method proposed in the present disclosure is implementable.

FIG. 3 is a view illustrating an example of a Bluetooth communication architecture to which the methods proposed in the present disclosure is implementable.

FIG. 4 is a view illustrating an example of a structure of GATT Profile of the Bluetooth low energy.

FIG. 5 is a flowchart illustrating a method for forming a connection between devices using the Bluetooth Low Energy (LE).

FIG. 6 is a view schematically illustrating a method for controlling another device through a control device proposed in the present disclosure.

FIGS. 7 and 8 are views illustrating an example of a profile structure for providing a service for controlling a device proposed in the present disclosure.

FIG. 9 is a flowchart illustrating an example of entire message transmission procedures for controlling a device proposed in the present disclosure.

FIG. 10 is a flowchart illustrating an example of a method for controlling a device connection proposed in the present disclosure.

FIGS. 11 and 12 are views illustrating an example of a method for transmitting an error message and a data format proposed in the present disclosure.

FIG. 13 is a flowchart illustrating another example of a method for transmitting an error message proposed in the present disclosure.

FIG. 14 is a view illustrating an example of a method for outputting an error message proposed in the present disclosure.

FIG. 15 is a view illustrating an example of a method for outputting an error message proposed in the present disclosure.

FIG. 16 is a view illustrating another example of a method for outputting an error message proposed in the present disclosure.

FIG. 17 is a view illustrating another example of a method for outputting an error message proposed in the present disclosure.

FIG. 18 is a view illustrating another example of a method for outputting an error message proposed in the present disclosure.

DETAILED DESCRIPTION OF THE INVENTION

The aforementioned objects, features and advantages of the present invention will become more apparent through the following detailed description with respect to the accompanying drawings. Hereinafter, the embodiments of the present invention will be described with reference to the accompanying drawings, in which like numbers refer to like elements throughout the specification. In describing the present invention, a detailed description of known techniques associated with the present invention unnecessarily obscure the gist of the present invention, it is determined that the detailed description thereof will be omitted.

Hereinafter, a terminal related to the present invention will be described in detail with reference to the accompanying drawings. In the following description, usage of suffixes such as 'module', 'part' or 'unit' used for referring to elements is given merely to facilitate explanation of the present invention, without having any significant meaning by itself.

FIG. 1 is a schematic view illustrating an example of a wireless communication system using a Bluetooth low energy technology to which the present invention is applicable.

A wireless communication system 100 includes at least one server device 120 and at least one client device 110.

The server device and the client device perform Bluetooth communication using a Bluetooth low energy (BLE) technology.

First, compared with a Bluetooth basic rate/enhanced data rate (BR/EDR), the BLE technology has a relatively small duty cycle, may be produced at low cost, and significantly reduce power consumption through a low data rate, and thus, it may operate a year or longer when a coin cell battery is used.

Also, in the BLE technology, an inter-device connection procedure is simplified and a packet size is designed to be small compared with the Bluetooth BR/EDR technology.

In the BLE technology, (1) the number of RF channels is forty, (2) a data rate supports 1 Mbps, (3) topology has a scatternet structure, (4) latency is 3 ms, (5) a maximum current is 15 mA or lower, (6) output power is 10 mW (10 dBm) or less, and (7) the BLE technology is commonly used in applications such as a clock, sports, healthcare, sensors, device control, and the like.

The server device 120 may operate as a client device in a relationship with other device, and the client device may operate as a server device in a relationship with other device. That is, in the BLE communication system, any one device may operate as a server device or a client device, or may operate as both a server device and a client device if necessary.

The server device 120 may also be called as data service device, slave device, slave, server, conductor, host device, gateway, sensing device, monitoring device, first device, or the like, and the client device 110 may also be called as master device, master, client, member, sensor device, sink device, collector, second device, third device, and the like.

The server device and the client device correspond to major components of the wireless communication system, and the wireless communication system may include components other than the server device and the client device.

The server device refers to a device which receives data from the client device and provides data to the client device in response when a corresponding request is received from the client device, through direct communication with the client device.

Also, in order to provide data information to the client device, the server device sends a notification message or an indication message to the client device in order to provide data information to the client device. Also, the server device receives a confirmation message corresponding to the indication message from the client device.

Also, in the process of transmitting and receiving notification, indication, and confirmation messages to and from the client device, the server device may provide data information to a user through a display unit or may receive a request input from the user through a user input interface.

Also, in the process of transmitting and receiving message to and from the client device, the server device may read data from a memory unit or may write new data to the corresponding memory unit.

Also, the single server device may be connected with a plurality of client devices, and may be easily re-connected with client devices using bonding information.

The client device 120 refers to a device which requests data information and data transmission from the server device.

The client device receives data through a notification message or an indication message from the server device, and when an indication message is received from the server device, the client device sends an acknowledgement message in response to the indication message.

Similarly, in the process of transmitting and receiving messages to and from the server device, the client device may also provide information to the user through a display unit or may receive an input from the user through a user input interface.

Also, in the process of transmitting and receiving messages with the server device, the client device may read data from a memory unit or may write new data to the corresponding memory unit.

Hardware components such as the display units, the user input interfaces, and the memory units of the server device and the client device will be described in detail with reference to FIG. 2.

Also, the wireless communication system may configure personal area networking (PAN) through the Bluetooth technology. For example, in the wireless communication system, a private piconet may be established between devices to quickly and safely exchange files, documents, and the like.

FIG. 2 is an example of an internal block diagram of a device in which the method proposed in the present disclosure is implementable.

As illustrated in FIG. 2, a server device includes a display unit 111, a user input interface 112, a power supply unit 113, a processor 114, a memory unit 115, a Bluetooth interface 116, other interface 117, and a communication unit (or transceiver unit) 118.

The display unit 111, the user input interface 112, the power supply unit 113, the processor 114, the memory unit 115, the Bluetooth interface 116, other interface 117, and the communication unit 118 are functionally connected to each other to perform a method proposed in this disclosure.

Also, the client device includes a display unit 121, a user input interface 122, a power supply unit 123, a processor 124, a memory unit 125, a Bluetooth interface 126, and a communication unit (or transceiver unit) 128.

The display unit 121, the user input interface 122, the power supply unit 123, the processor 124, the memory unit 125, the Bluetooth interface 126, other interface 127, and the communication unit 128 are functionally connected to each other to perform a method proposed in this disclosure.

The Bluetooth interfaces 116 and 126 refer to units (or modules) able to transmit data such as a request/a response, a command, a notification, an indication/confirmation message between devices.

The memory units 115 and 126 are units implemented in various types of devices, in which various types of data are stored.

The processors 114 and 124 refer to modules controlling a general operation of the server device or the client device, which control requesting transmission of a message through the Bluetooth interface and other interface and processing a received message therethrough.

The processors 114 and 124 may also be termed a controller, a control unit, and the like.

The processors 114 and 124 may include an application-specific integrated circuit (ASIC), other chip set, a logic circuit and/or data processing unit.

The processors 114 and 124 control the communication units to receive an advertising message from the server device, control the communication unit to transmit a scan request message to the server device and receive a scan response message as a response to the scan request from the server device, and control the communication unit to transmit a connection request message to the server device in order to establish a Bluetooth connection with the server device.

Also, after the Bluetooth LE connection is established through the connection procedure, the processors 114 and 124 control the communication units to read or write data by using an attribute protocol from the server device The memory units 115 and 125 may include a read-only memory (ROM), a random access memory (RAM), a flash memory, a memory card, a storage medium and/or other storage device.

The communication units 118 and 127 may include a baseband circuit for processing a wireless signal. When an embodiment is implemented by software, the aforementioned technique may be implemented as a module (process, function, etc.) performing the aforementioned function. The module may be stored in a memory unit and may be executed by a processor.

The memory units 115 may be present within or outside of the processors 114 and 124, and may be connected to the processors 114 and 124 through various well-known units.

The display units 111 and 121 refer to modules providing status information of the devices, message exchange information, and the like, to the user through a screen.

The power supply units 113 and 123 refer to modules receiving external power or internal power and supplying power required for operations of the respective components under the control of the controllers 114 and 124.

As discussed above, in the BLE technology, a duty cycle is small and power consumption may be significantly reduced through a low data rate.

The user input interfaces 112 and 122 refer to modules providing a user input such as a screen button to the controllers to enable the user to control an operation of the devices.

FIG. 3 is a view illustrating an example of a Bluetooth communication architecture to which the methods proposed in the present disclosure is implementable.

Referring to FIG. 3, FIG. 3A shows an example of a protocol stack of the Bluetooth BR (Basic Rate)/EDR (Enhanced Data Rate), and FIG. 3B shows an example of a protocol stack of the Bluetooth Low Energy (LE).

In detail, as illustrated in (a) of FIG. 3, the Bluetooth BR/EDR protocol stack may include an upper controller stack 10 and a lower host stack 20 with respect to a host controller interface (HCI) 18.

The host stack (or host module) 20 refers to hardware for transmitting or receiving a Bluetooth packet to and from a wireless transceiver module receiving a Bluetooth signal of 2.4 GHz, and is connected to a Bluetooth module, the controller stack 10, to control the Bluetooth module and performs an operation.

The host stack 10 may include a PHY layer 12, a Link Controller layer 14 and a Link Manager layer 16.

The PHY layer 12 is the layer of transmitting and receiving a radio signals of 2.4 GHz, and may transmit data by hopping 79 RF channels in the case of using the Gaussian Frequency Shift Keying (GFSK) modulation.

The Link Controller layer 14 plays the role of transmitting a Digital Signal, selects the channel sequence of hopping 1400 times per second, and transmits the time slot of 625 μs length for each channel.

The Link Manager layer 16 controls the entire operations (link setup, control and security) of a Bluetooth connection by utilizing the Link Manager Protocol (LMP).

The link manager layer 16 may perform the following functions.

- The link manager layer 16 may perform ACL/SCO logical transport, logical link setup, and control
- Detach: The link manager layer 16 stops connection and informs a counterpart device about the reason for stopping connection.
- The link manager layer 16 performs power control and role switch.
- The link manager layer 16 performs security (authentication, pairing, encryption) function.

The host controller interface layer 18 provides an interface between the host module and the controller module to allow the host to provide a command and data to the controller and allow the controller to provide an event and data to the host.

The host stack (or host module) 20 includes a logical link control and adaptive protocol (L2CAP) 21, an attribute protocol (ATT) 22, a generic attribute profile (GATT) 23, a generic access profile (GAP) 24, and a BR/EDR profile 25.

The logical link control and adaptive protocol (L2CAP) 21 may provide a two-way channels for transmitting data to a specific protocol or a profile.

The L2CAP 21 may multiplex various protocols and profiles provided from a Bluetooth higher position.

The L2CAP of the Bluetooth BR/EDR uses a dynamic channel, supports a protocol service multiplexer, retransmission, and a streaming mode, and provides segmentation and reassembly, per-channel flow control, and error control.

The generic attribute profile (GATT) 23 may operate as a protocol how the attribute protocol 22 is used in configuring services. For example, the generic attribute profile 23 may operate how ATT attributes are grouped together with services, and operate to describe features associated with services.

Thus, the GATT 23 and the ATT 22 may use features in order to describe status and services of a device and describe how the features are related and used.

The attribute protocol 22 and the BR/EDR profile 25 define a service (profile) using the Bluetooth BR/EDR and define an application protocol for exchanging data, and the generic access profile (GAP) 24 defines device discovering, connecting a device and security level.

As illustrated in (b) of FIG. 4, the Bluetooth LE protocol stack includes a controller stack 30 operable to process a wireless device interface for which timing is important, and a host stack 40 operable to process high level data.

First, the controller stack 30 may be implemented by using a communication module that may include a Bluetooth wireless device, for example, a processor module that may include a processing device such as a microprocessor.

The host stack may be implemented as part of an OS operated on a processor module or may be implemented as instantiation of a package on the OS.

In some examples, the controller stack and the host stack may be operated or executed on the same processing device within a processor module.

The controller stack 30 includes a physical layer (PHY) 32, a link layer (LL) 34, and a host controller interface (HCI) 36.

The physical layer (PHY) (wireless transceiver module 32), a layer for transmitting and receiving a 2.4 GHz wireless signal, uses a Gaussian frequency shift keying (GFSK) modulation and a frequency hopping technique including forty RF channels.

The link layer 34 serving to transmit or receive a Bluetooth packet provides a function of generating a connection between devices after performing an advertising and scanning function using three advertising channels, and exchanging data packets of a maximum of 257 bytes through thirty-seven data channels.

The host stack may include the logical link control and the adaptation protocol (L2CAP) 41, the Security Manager (SM) 42, the Attribute Protocol (ATT) 43, the Generic Attribute Profile (GATT) 44, the Generic Access Profile 45 and the LE profile 46. However, the host stack 40 is not limited thereto, but may include other various protocols and profiles.

The host stack multiplexes various protocols and profiles provided from a Bluetooth higher position by using the L2CAP.

First, the L2CAP 41 may provide a single two-way channel for transmitting data to a specific protocol or profile.

The L2CAP 41 may operate to multiplex data between higher layer protocols, segment and reassemble packages, and manage a multicast data transmission.

In the Bluetooth LE, three fixed channels (one for a signaling channel, one for a security manager, and one for an attribute protocol) are basically used, and dynamic channel may be used as necessary.

In contrast, in the BR/EDR, a dynamic channel is basically used, and a protocol service multiplexer, retransmission, streaming mode, and the like, are supported.

The SM 42 is a protocol for certifying a device and providing a key distribution.

The ATT 43 defines a rule for accessing data of a counterpart device by a server-client structure. The ATT 43 includes six types of messages (request, response, command, notification, indication, and confirmation) as follows.

1̂ Request and Response message: A request message is a message for a client device to request specific information from a server device, and the response message, as a response message with respect to the request message, refers to a message transmitted from the server device to the client device.

2̂ Command message: It is a message transmitted from the client device to the server device in order to indicate a command of a specific operation. The server device does not transmit a response with respect to the command message to the client device.

3̂ Notification message: It is a message transmitted from the server device to the client device in order to notify an event, or the like. The client device does not transmit a confirmation message with respect to the notification message to the server device.

4̂ Indication and confirmation message: It is a message transmitted from the server device to the client device in order to notify an event, or the like. Unlike the notification message, the client device transmits a confirmation message regarding the indication message to the server device.

In the present invention, when the GATT profile using the attribute protocol (ATT) 43 requests long data, a value regarding a data length is transmitted to allow a client to clearly know the data length, and a characteristic value may be received from a server by using a universal unique identifier (UUID).

The generic access profile (GAP) 45, a layer newly implemented for the Bluetooth LE technology, is used to select a role for communication between Bluetooth LED devices and to control how a multi-profile operation takes place.

Also, the generic access profile (GAP) 45 is mainly used for device discovery, connection generation, and security procedure part, defines a scheme for providing information to a user, and defines types of attributes as follows.

1̂ Service: It defines a basic operation of a device by a combination of behaviors related to data 2̂ Include: It defines a relationship between services 3̂ Characteristics: It is a data value used in a server 4̂ Behavior: It is a format that may be read by a computer defined by a UUID (value type).

The LE profile 46, including profiles dependent upon the GATT, is mainly applied to a Bluetooth LE device. The LE profile 46 may include, for example, Battery, Time, FindMe, Proximity, Time, Object Delivery Service, and the like, and details of the GATT-based profiles are as follows.

1̂ Battery: Battery information exchanging method

2̂ Time: Time information exchanging method

3̂ FindMe: Provision of alarm service according to distance

4̂ Proximity: Battery information exchanging method

5̂ Time: Time information exchanging method

The generic attribute profile (GATT) 44 may operate as a protocol describing how the attribute protocol (ATT) 43 is used when services are configured. For example, the GATT 44 may operate to define how ATT attributes are grouped together with services and operate to describe features associated with services.

Thus, the GATT 44 and the ATT 43 may use features in order to describe status and services of a device and describe how the features are related and used.

Hereinafter, procedures of the Bluetooth low energy (BLE) technology will be briefly described.

The BLE procedure may be classified as a device filtering procedure, an advertising procedure, a scanning procedure, a discovering procedure, and a connecting procedure.

Device Filtering Procedure

The device filtering procedure is a method for reducing the number of devices performing a response with respect to a request, indication, notification, and the like, in the controller stack.

When requests are received from all the devices, it is not necessary to respond thereto, and thus, the controller stack may perform control to reduce the number of transmitted requests to reduce power consumption.

An advertising device or scanning device may perform the device filtering procedure to limit devices for receiving an advertising packet, a scan request or a connection request.

Here, the advertising device refers to a device transmitting an advertisement event, that is, a device performing an advertisement and is also termed an advertiser.

The scanning device refers to a device performing scanning, that is, a device transmitting a scan request.

In the BLE, in a case in which the scanning device receives some advertising packets from the advertising device, the scanning device should transmit a scan request to the advertising device.

However, in a case in which a device filtering procedure is used so a scan request transmission is not required, the scanning device may disregard the advertising packets transmitted from the advertising device.

Even in a connection request process, the device filtering procedure may be used. In a case in which device filtering is used in the connection request process, it is not necessary to transmit a response with respect to the connection request by disregarding the connection request.

Advertising Procedure

The advertising device performs an advertizing procedure to perform undirected broadcast to devices within a region.

Here, the undirected broadcast is advertizing toward all the devices, rather than broadcast toward a specific device, and all the devices may scan advertising to make an additional information request or a connection request.

In contrast, directed advertising may make an additional information request or a connection request by scanning advertising for only a device designated as a reception device.

The advertising procedure is used to establish a Bluetooth connection with an initiating device nearby.

Or, the advertising procedure may be used to provide periodical broadcast of user data to scanning devices performing listening in an advertising channel.

In the advertising procedure, all the advertisements (or advertisement events) are broadcast through an advertisement physical channel.

The advertising devices may receive scan requests from listening devices performing listening to obtain additional user data from advertising devices. The advertising devices transmit responses with respect to the scan requests to the devices which have transmitted the scan requests, through the same advertising physical channels as the advertising physical channels in which the scan requests have been received.

Broadcast user data sent as part of advertising packets are dynamic data, while the scan response data is generally static data.

The advertisement device may receive a connection request from an initiating device on an advertising (broadcast) physical channel. If the advertising device has used a connectable advertising event and the initiating device has not been filtered according to the device filtering procedure, the advertising device may stop advertising and enter a connected mode. The advertising device may start advertising after the connected mode.

Scanning Procedure

A device performing scanning, that is, a scanning device performs a scanning procedure to listen to undirected broadcasting of user data from advertising devices using an advertising physical channel.

The scanning device transmits a scan request to an advertising device through an advertising physical channel in order to request additional data from the advertising device. The advertising device transmits a scan response as a response with respect to the scan request, by including additional user data which has requested by the scanning device through an advertising physical channel.

The scanning procedure may be used while being connected to other BLE device in the BLE piconet.

If the scanning device is in an initiator mode in which the scanning device may receive an advertising event and initiates a connection request. The scanning device may transmit a connection request to the advertising device through the advertising physical channel to start a Bluetooth connection with the advertising device.

When the scanning device transmits a connection request to the advertising device, the scanning device stops the initiator mode scanning for additional broadcast and enters the connected mode.

Discovering Procedure

Devices available for Bluetooth communication (hereinafter, referred to as "Bluetooth devices") perform an advertising procedure and a scanning procedure in order to discover devices located nearby or in order to be discovered by other devices within a given area.

The discovering procedure is performed asymmetrically. A Bluetooth device intending to discover other device nearby is termed a discovering device, and listens to discover devices advertising an advertising event that may be scanned. A Bluetooth device which may be discovered by other device and available to be used is termed a discoverable device and positively broadcasts an advertising event such that it may be scanned by other device through an advertising (broadcast) physical channel.

Both the discovering device and the discoverable device may have already been connected with other Bluetooth devices in a piconet.

Connecting Procedure

A connecting procedure is asymmetrical, and requests that, while a specific Bluetooth device is performing an advertising procedure, another Bluetooth device should perform a scanning procedure.

That is, an advertising procedure may be aimed, and as a result, only one device may response to the advertising. After a connectable advertising event is received from an advertising device, a connecting request may be transmitted to the advertising device through an advertising (broadcast) physical channel to initiate connection.

Hereinafter, operational states, that is, an advertising state, a scanning state, an initiating state, and a connection state, in the BLE technology will be briefly described.

Advertising State

A link layer (LL) enters an advertising state according to an instruction from a host (stack). In a case in which the LL is in the advertising state, the LL transmits an advertising packet data unit (PDU) in advertising events.

Each of the advertising events include at least one advertising PDU, and the advertising PDU is transmitted through an advertising channel index in use. After the advertising PDU is transmitted through an advertising channel index in use, the advertising event may be terminated, or in a case in which the advertising device may need to secure a space for performing other function, the advertising event may be terminated earlier.

Scanning State

The LL enters the scanning state according to an instruction from the host (stack). In the scanning state, the LL listens to advertising channel indices.

The scanning state includes two types: passive scanning and active scanning. Each of the scanning types is determined by the host.

Time for performing scanning or an advertising channel index are not defined.

During the scanning state, the LL listens to an advertising channel index in a scan window duration. A scan interval is defined as an interval between start points of two continuous scan windows.

When there is no collision in scheduling, the LL should listen in order to complete all the scan intervals of the scan window as instructed by the host. In each scan window, the LL should scan other advertising channel index. The LL uses every available advertising channel index.

In the passive scanning, the LL only receives packets and cannot transmit any packet.

In the active scanning, the LL performs listening in order to be relied on an advertising PDU type for requesting advertising PDUs and advertising device-related additional information from the advertising device.

Initiating State

The LL enters the initiating state according to an instruction from the host (stack).

When the LL is in the initiating state, the LL performs listening on advertising channel indices.

During the initiating state, the LL listens to an advertising channel index during the scan window interval.

Connection State

When the device performing a connection state, that is, when the initiating device transmits a CONNECT_REQ PDU to the advertising device or when the advertising device receives a CONNECT_REQ PDU from the initiating device, the LL enters a connection state.

It is considered that a connection is generated after the LL enters the connection state. However, it is not necessary to consider that the connection should be established at a point in time at which the LL enters the connection state. The only difference between a newly generated connection and an already established connection is a LL connection supervision timeout value.

When two devices are connected, the two devices play different roles.

An LL serving as a master is termed a master, and an LL serving as a slave is termed a slave. The master adjusts a timing of a connecting event, and the connecting event refers to a point in time at which the master and the slave are synchronized.

Hereinafter, packets defined in an Bluetooth interface will be briefly described. BLE devices use packets defined as follows.

Packet Format

The LL has only one packet format used for both an advertising channel packet and a data channel packet.

Each packet includes four fields of a preamble, an access address, a PDU, and a CRC.

When one packet is transmitted in an advertising physical channel, the PDU may be an advertising channel PDU, and when one packet is transmitted in a data physical channel, the PDU may be a data channel PDU.

Advertising Channel PDU

An advertising channel PDU has a 16-bit header and payload having various sizes.

A PDU type field of the advertising channel PDU included in the heater indicates PDU types defined in Table 1 below.

TABLE 1

| PDU Type | Packet Name |
|---|---|
| 0000 | ADV_IND |
| 0001 | ADV_DIRECT_IND |
| 0010 | ADV_NONCONN_IND |
| 0011 | SCAN_REQ |
| 0100 | SCAN_RSP |
| 0101 | CONNECT_REQ |
| 0110 | ADV_SCAN_IND |
| 0111-1111 | Reserved |

Advertising PDU

The following advertising channel PDU types are termed advertising PDUs and used in a specific event.

ADV_IND: Connectable undirected advertising event

ADV_DIRECT_IND: Connectable directed advertising event

ADV_NONCONN_IND: Unconnectable undirected advertising event

ADV_SCAN_IND: Scannable undirected advertising event

The PDUs are transmitted from the LL in an advertising state, and received by the LL in a scanning state or in an initiating state.

Scanning PDU

The following advertising channel DPU types are termed scanning PDUs and are used in a state described hereinafter.

SCAN_REQ: Transmitted by the LL in a scanning state and received by the LL in an advertising state.

SCAN_RSP: Transmitted by the LL in the advertising state and received by the LL in the scanning state.

Initiating PDU

The following advertising channel PDU type is termed an initiating PDU.

CONNECT_REQ: Transmitted by the LL in the initiating state and received by the LL in the advertising state.

Data Channel PDU

The data channel PDU may include a message integrity check (MIC) field having a 16-bit header and payload having various sizes.

The procedures, states, and packet formats in the BLE technology discussed above may be applied to perform the methods proposed in this disclosure.

FIG. 4 is a view illustrating an example of a structure of GATT Profile of the Bluetooth low energy.

Referring to FIG. 4, the structure for exchange of Profile Data of the Bluetooth Low Energy is shown.

In detail, the GATT defines a method for exchanging data using a service between Bluetooth LE devices and a characteristic.

In general, a peripheral device (for example, a sensor device) serves as a GATT server, and has definition regarding a service and a characteristic.

In order to read or write data, a GATT client sends a data request to the GATT server, and every operation (transaction) is started by the GATT client and a response is received from the GATT server.

A GATT-based operational structure used in the Bluetooth LE may be a vertical structure as illustrated in FIG. 5 on the basis of a profile, a service, and a characteristic.

The profile includes one or more services, and the services may include one or more characteristics or other services.

The service serves to divide data into logical units and may include one or more characteristics or other services, each of the services has a 16-bit or 128-bit identifier called a universal unique identifier (UUID)).

The characteristic is the lowermost unit in the GATT-based operational structure. The characteristic includes only one data, and has a 16-bit or 128-bit UUID, similar to the service.

The characteristic is defined by values of various types of information, and in order to hold each information, an attribute may be required for each information. The characteristic may use several continuous attributes.

The attribute has four components and has meanings as follows.

handle: Address of attribute

Type: Type of attribute

Value: Value of attribute

Permission: Right to access attribute

The present invention proposes a method for controlling a device by acquiring the association information and the information in relation to a controllable operation of a device which is to be controlled by a control device through the GATT.

FIG. 5 is a flowchart illustrating a method for forming a connection between devices using the Bluetooth Low Energy (LE).

As shown in FIG. 5, for the Bluetooth LE connection between a first device 300 and a second device 400, the first device 300 transmits an Advertising Message to the second device 400 (step, S5010).

In this case, the Advertising Message may be transmitted in the broadcast scheme or the unicast scheme.

As described above, the Advertising Message is used for providing the information of a device to another device by utilizing the Bluetooth LE, and may include various types of information such as the service information provided by the device, the user information, and so on.

The second device 400 may discover the first device 300 through the Advertising Message.

After identifying the information included in the Advertising Message, the second device 400 transmits a connection request message for connecting the Bluetooth LE connection to the first device 300 (step, S5020), and the first device 300 and the second device 400 establish a Bluetooth Low Energy (LE) connection (step, S5030).

Such a method has a disadvantage that a user is unable to control the connection establishment and it is impossible to check a PIN number and to control a connection configuration in case that a User Interface (UI) is not existed in the first device 300 and/or the second device 400.

Accordingly, in order to solve the problem, the present invention proposes a method for controlling the first device 300 and the second device 400 by using a third device.

FIG. 6 is a view schematically illustrating a method for controlling another device through a control device proposed in the present disclosure.

As shown in FIG. 6, a third device 500 is required to control the operation between the first device 300 and the second device 400, and the third device 500 requires a new control protocol in order to control the association of the first device 300 and the second device 400.

Hereinafter, the control device for controlling the operation of the first device 300 and the second device 400 is referred to as the third device 500.

In this case, in order to control the operation of the devices, the third device 500 should know the information (e.g., interface information, service information, etc.) of the devices.

FIGS. 7 and 8 are views illustrating an example of a profile structure for providing a service for controlling a device proposed in the present disclosure.

Referring to FIG. 7 and FIG. 8, the service for a control device to control other devices may be included in the profile of other services together, or defined by a separate profile.

Hereinafter, the service for the control device to control other devices is called an Easy Pairing Service.

The third device 500, which is the control device, may control other devices through the Easy Pairing Service. For example, the third device 500 may control the operations related to the association (e.g., connection, pairing or bonding) between the first device 300 and the second device 400 through the Easy Pairing Service.

In this case, the Easy Pairing Service may be included in the profile of other services as shown in FIG. 7, or defined by a separate profile as shown in FIG. 8.

In the case that the Easy Pairing Service is included in the profile of a specific service, not defined by a separate profile, as shown in FIG. 7, there is an advantage of being easy to describe the operation of an application.

However, the Easy Pairing Service is unable to be applied up to the service of profile that does not include the Easy Pairing Service, but the role between devices should be clearly defined.

As shown in FIG. 8, in the case that the Easy Pairing Service is defined by a separate profile, there is an advantage that the server/client structure is compatible in the profile level, and the Easy Pairing Service may be extendedly applied to other profile.

FIG. 9 is a flowchart illustrating an example of entire message transmission procedures for controlling a device proposed in the present disclosure.

Referring to FIG. 9, the third device 500 may control the first device 300 or the second device 400 through the Bluetooth connection with the first device 300 or the second device 400.

Particularly, the third device 500 discovers the first device 300 and/or the second device 400 through the Discovery Procedure (step, S9010).

The Discovery Procedure may be performed through the Advertising Message transmitted by the first device 300 and/or the second device 400 as described above, and the Advertising Message may include the information (e.g., device ID and device address) of the device that transmits the Advertising Message, the service information that represents the service that may be provided, and the like.

In this case, the Advertising Message may include the service information that represents whether the first device 300 and/or the second device 400 support(s) the Easy Pairing Service.

The third device 500 that discovers the first device 300 and/or the second device 400 through the Discovery Procedure may form a Bluetooth connection through the connection procedure with the discovered device (step, S9020).

Later, through an authentication procedure, the third device 500 performs device authentication with the first device 300 and/or the second device 400 (step, S9030).

The third device 500 that completes the authentication of the device through the authentication procedure may control the operation in relation to the association with the first device 300 and/or the second device 400 through the Association Control with the first device 300 and/or the second device 400 (step, S9040).

In this case, the third device 500 may instruct the first device 300 and/or the second device 400 to perform the operation for a specific state through the association control.

For example, the third device 500 may instruct the first device 300 to establish a connection with the second device 400 through the association control step, S9040.

The first device 300 and/or the second device 400 instructed to establish the connection by the third device 500 may establish the connection with the first device 300 and/or the second device 400 through the discovery procedure S9050, the connection procedure S9060 and the authentication procedure S9070.

Later, the first device 300 and/or the second device 400 may notify that the connection is established to the third device 500 by transmitting a Notification message to the third device 500 (step, S9080).

The first device 300 and the second device 400 may perform the data transmission and reception through the established connection (step, S9100).

Later, the first device 300 may terminate the connection with the second device when the first device 300 receives the Connection Termination message that indicates to terminate the connection from the third device 500 (steps, S9100 and S9110).

However, in the case that an error occurs since the first device 300 fails to perform the operation instructed by the third device 500, there is a problem that the third device 500 may not know which error is occurred particularly.

Accordingly, the present invention proposes a method for transmitting the error and cause which are occurred to the control device when an error occurs during providing the Easy Pairing Service.

FIG. 10 is a flowchart illustrating an example of a method for controlling a device connection proposed in the present disclosure.

Referring to FIG. 10, through the Easy Pairing Service described above, a control device may control a connection between devices.

First, it is assumed that the first device 300, the second device 400 and the third device 500 support the Easy Pairing Service.

In particular, the third device 500, which is the control device, performs the procedure for forming the Bluetooth LE connection with the first device 300 and the second device 400, which are the controlled devices, and is existed in the connected state.

First, it is assumed that the first device 300, the second device 400 and the third device 500 support the Easy Pairing Service.

The third device 500 transmits a request message for instructing a specific operation with the second device 400 to the first device 300 (step, S10010).

In this case, the request message may be the write request message that requests to write for the instruction of the specific operation to the Characteristics of the first device 300.

Hereinafter, it is assumed and described that the specific operation is to form a Bluetooth LE connection with the second device 400.

The first device 300 transmits a response message in response to the request message to the third device 500 (step, S10020).

In this case, the response message may be selectively transmitted, and in the case that the request message is the write request message, the response message may be a write response message.

Since the first device 300 receives the request message to instruct to form a connection with the second device 400 by the third device 500, the first device 300 performs the procedure for establishing the connection with the second device 400.

Particularly, after the first device 300 discovers the second device 400, the first device 300 establishes a connection with the second device 400 by transmitting the request message to request to form the connection with the second device 400 (steps, S10030 and S10040).

However, in the case that the first device 300 is unable to form a connection with the second device 400 due to the reason why the first device 300 gets out of communication distance from the second device 400 and so on, the method for notifying it to the third device 500 is required.

In addition, in the case of the conventional Bluetooth LE, there is a problem that it will take a long time consumed until determining as a connection failure since a response is not transmitted from the second device 400 after the first device 300 transmits a connection request message to the second device 400.

Accordingly, in order to solve the problem, in the case that an error occurs since it is unable to perform an instructed operation, the present disclosure proposes a method for transmitting the detailed cause and the content of the error to a control device and shortening a connection wait time for efficiently determining whether the error occurs or not.

FIGS. 11 and 12 are views illustrating an example of a method for transmitting an error message and a data format proposed in the present disclosure.

First, it is assumed that the first device 300, the second device 400 and the third device 500 support the Easy Pairing Service, and each pair of the third device 500 and the first device 300, and the third device 500 and the second device 400 establish a connection through the Bluetooth LE connection procedure.

Referring to FIGS. 11 and 12, in the case that the first device 300 is unable to perform a specific operation instructed by the third device 500, the first device 300 may transmit an error message that represents that the first device 300 fails to perform the specific operation together with detailed causes to the third device 500.

The third device 500 transmits a request message for instructing the specific operation with the second device 400 to the first device 300 (step, S11010).

In this case, the request message may be a write request message that requests to write for an instruction on the specific operation in the characteristics of the first device 300.

The first device 300 that receives the request message operates a timer that is terminated after a specific time in order to receive a response to the specific operation from the second device 400.

Hereinafter, it is assumed and described that the specific operation is to establish the Bluetooth LE connection with the second device 400.

The first device 300 transmits a response message in response to the request message to the third device 500 (step, S11020).

In this case, the response message may be selectively transmitted. In the case that the request message is the write request message, the response message may be a write response message.

The first device 300 receives the request message that instructs to form a connection with the second device 400 from the third device 500, and accordingly, the first device 300 performs a procedure for establishing a connection with the second device 400.

Particularly, after discovering the second device 400, the first device 300 transmits a request message that requests to establish a connection to the second device 400 (step, S11030).

FIG. 12A shows an example of the data format of the connection request message. As shown in FIG. 12A, the data format may include the type fields that represent data types and the data fields according to the type fields.

The offset value of the type field shown in FIG. 12A is an example, and the data field may have different offset value.

In the case that the type is "Timeout" in FIG. 12A, the data value according to the type includes the time information that represents operation time of the timer. That is, the data value includes a value from the start to the end of the timer.

For example, in the case that the data value according to the "Timeout" type is '3s', the first device may determine the connection to be failed if there is no response within 3 seconds from the second device after the first device receives a request message from the third device 500.

In this case, the "Time out" value is set to be smaller than '30s' which is the timer value for determining a connection failure in the connection procedure between devices which is defined in "Bluetooth Core Spec 4.2".

In the case that the first device 300 receives a response from the second device 400 before the timer is terminated, after the first device 300 transmits the connection request message, the first device 300 establishes the Bluetooth LE connection with the second device 400, and notifies that the connection is established by transmitting a notice message to the third device 500.

However, in the case that the timer fails to receive a response for the connection request message from the second device 400 till the termination after specific time has passed, the first device 300 determines that an error occurs during the connection procedure and transmits an error message representing that an error occurs to the third device (step, S11040).

In this case, the error message may include the information that represents detailed causes of the error.

FIG. 12B shows an example of the data format of the error message. As shown in FIG. 12B, the data format may include the type field that includes an offset value representing that an error occurs and the data field that represents detailed cause of error according to the offset value.

The cause for the error may include various causes why the first device 300 and the second device 400 fail to establish a connection.

For example, the data field may represent the following causes.

- No Response: there is no response since the second device 400 gets out of the available distance to transmit data through the Bluetooth or is not be operated.
- Host Busy: the first device 300 performs other operation.
- Key Mismatching: the keys generated through the encoding algorithm between the first device 300 and the second device 400 are not the same.
- Not Allowed: the second device 400 is not a device that the connection with the first device 300 is allowed.

The above errors mentioned are an example, and other various causes to make an error may be existed.

In the causes for the errors, the Key Mismatching occurs when it is not available to establish a connection since the keys are not identical between the key generated by the first device 300 through the encoding algorithm and the key generated by the second device 400 through the encoding algorithm are not identical.

In addition, for Not Allowed, in the case that the first device 300 includes the whitelist that represents the list of the devices that are allowed to connect, when the second device 400 is not included in the whitelist.

As such, by configuring the operation time of the timer shortly, the first device 300 may quickly determine whether to perform the specific operation instructed by the third device 500, and in the case that an error occurs, the first device 300 may notify the detailed cause for the error to the third device 500.

FIG. 13 is a flowchart illustrating another example of a method for transmitting an error message proposed in the present disclosure.

First, it is assumed that the first device 300, the second device 400 and the third device 500 support the Easy Pairing Service, and each pair of the third device 500 and the first device 300, and the third device 500 and the second device 400 establish a connection through the Bluetooth LE connection procedure.

Referring to FIG. 13, the third device 500 transmits a request message that instructs a specific operation to the second device 400 as well as the first device 300. In the case that the first device 300 and the second device 400 are unable to perform the specific operation, the first device 300 and the second device 400 may transmit an error message representing that they fail to perform the specific operation together with the detailed causes to the third device 500.

Particularly, the third device 500 transmits a request message (a first request message) to instruct a specific operation with the second device 400 to the first device 300 (step, S13010).

In addition, the third device 500 transmits a request message (a second request message) to instruct the specific operation which is the same as the instruction for the first device 300 to the second device 400 (step, S13020).

In this case, the first request message and the second request message may be a write request message that request to write for the instruction on the specific operation to the characteristic of the first device 300 and the second device 400.

The first device 300 that receives the request message operates a timer (a first timer) that is terminated after a specific time in order to receive a response to the specific operation from the second device 400, and also, the second device 400 operates a timer (a second timer) that is terminated after a specific time in order to receive a response for the specific operation from the first device 300.

Hereinafter, it is assumed and described that the specific operation is to establish the Bluetooth LE connection with the second device 400.

The first device 300 and the second device 400 transmit a response message in response to the request message to the third device 500 (steps, S13030 and S13040).

In this case, the response message may be selectively transmitted. In the case that the request message is the write request message, the response message may be a write response message.

Each of the first device 300 and the second device 400 receive the request message that instructs to form a connection with the counterpart device from the third device 500, and accordingly, the first device 300 and the second device 400 perform a procedure for establishing a connection with the counterpart device.

Particularly, after discovering the counterpart device, the first device 300 and the second device 400 transmit the request messages (the first connection request message and the second connection request message) that request to establish a connection to the counterpart device (steps, S13050 and S13060).

The data format of the request message is the same as that of shown in FIG. 12A described above.

In the case that the first device 300 and the second device 400 receive a response from the counterpart device before the first timer and the second timer are terminated, after transmitting the connection request message, the first device 300 and the second device 400 establish the Bluetooth LE connection with the counterpart device, and notify the connection to be established by transmitting notice messages (a first notice message and a second notice message) to the third device 500.

However, in the case that the first device 300 and the second device 400 fail to receive a response to the connection request message from the counterpart device till the first timer and the second timer are terminated after passing the specific time, the first device 300 and the second device 400 determine that an error occurs during the connection procedure and transmit error messages (a first error message and a second error message) representing that an error occurs to the third device (steps, S13070 and S13080).

In this case, each of the error messages may include the information of the detailed reason why the error occurs (the first information of the reason and the second information of the reason).

The data format of the error message is the same as that of shown in FIG. 12A described above.

Through such a method, different from FIG. 11, the third device 500 may instruct a specific operation to the first device 300 and the second device 400. In the case that the first device 300 and the second device 400 fail to perform the specific operation, the third device 500 may receive an error message from each of the first device 300 and the second device 400.

FIG. 14 is a view illustrating an example of a method for outputting an error message proposed in the present disclosure.

Referring to FIG. 14, the third device 500 that receives an error message through the method described with reference to FIG. 11 to FIG. 13 may output detailed cause for the error included in the error message through an output unit.

Hereinafter, as an example of the specific operation, a connection operation will be described as an example.

Particularly, (a) in the case that the third device 500 tries to connect the first device 300 and the second device 400 through the Easy Pairing Service, the third device 500 may transmit a request message to instruct a connection to the first device 300.

However, in the case that the distance between the first device 300 and the second device 400 is longer than the distance that is available for communication through the Bluetooth, the first device 300 is unable to establish a connection with the second device 400.

That is, even though the first device 300 transmits a connection request message for connection to the second device 400, the first device 300 is unable to receive a response in response to the request.

In the case that the first device 300 fails to receive a response from the second device 400 till the timer described above is terminated, the first device 300 transmits an error message to the third device 500.

In this case, the cause for the error included in the error message is that a response is not received by the second device. It may be represented as "No Response" from the reason that the second device 400 is a great distance away not available to communicate or broken down.

(b) The third device 500 that receives the error message may notify that the first device 300 and the second device 400 are not connected to a user by outputting the detailed cause for the error since the first device 300 and the second device 400 are not connected.

FIG. 15 is a view illustrating an example of a method for outputting an error message proposed in the present disclosure.

Referring to FIG. 15, different from FIG. 14, in the case that the first device 300 and the third device 500 get out of a distance that is available for communication by moving the position, and are unable to perform a specific operation, the third device 500 may output detailed cause for the error included in the error message through an output unit.

Hereinafter, as an example of the specific operation, a connection operation will be described as an example.

Particularly, (a) 1̂ the third device 500 instructs the first device 300 to connect with the second device 400 through the Easy Pairing Service.

2̂ The first device 300 that is instructed by the third device 500 to connect with the second device 400 establishes a Bluetooth LE connection with the second device 400 through a connection procedure.

(b) Later, 3̂ in the case that the first device 300 and the third device 500 move to a position where the communication with the second device 400 is not available in a connected state, the connection between the first device 300 and the second device 400 is terminated.

4̂ The first device 300 that is unable to perform a communication any more since the connection with the second device 400 is closed notifies that there is no response from the second device 400 by transmitting an error message including the cause information that represents "No Response" to the third device 500, and the third device 500 outputs the cause information.

FIG. 16 is a view illustrating another example of a method for outputting an error message proposed in the present disclosure.

Referring to FIG. 16, in the case that the first device 300 instructed to do a specific operation by the third device 500 already performs other operation, the first device 300 may notice it by transmitting an error message to the third device 500.

Hereinafter, as an example of the specific operation, a connection operation will be described as an example.

Particularly, (a) 1̂ the first device 300 is performing an operation such as a connection procedure or data transmission and reception with a fourth device 600.

2̂ The third device 500 may transmit a request message that instructs a connection with the second device 400 to the first device 300 through the Easy Pairing Service while the first device 300 performs an operation such as a connection procedure with the fourth device 600, a data transmission and reception, or the like.

3̂ However, since the first device 300 already performs other operation with the fourth device 600, the first device 300 is unable to establish a connection with the second device 400.

4̂ Accordingly, the first device 300 transmits an error message that includes the cause information representing "Host Busy" to the third device 500 since the first device 300 performs other operation.

In this case, the "Host Busy" represents whether the first device 300 performs the operation instructed by the third device 500 after the other operation is completed as well as the first device 300 performs the other operation.

In the case that the "Host Busy" represents that the first device 300 performs the operation instructed by the third device 500 after the other operation is completed, the first device 300 may perform the operation instructed by the second device 400 and the third device 500 after the first device 300 completes the operation performed with the fourth device 600.

(b) The third device 500 that receives the error message may notify that the first device 300 and the second device 400 are not connected to a user by outputting detailed cause for the error since the first device 300 is not connected with the second device 400 by performing other operation currently.

FIG. 17 is a view illustrating another example of a method for outputting an error message proposed in the present disclosure.

Referring to FIG. 17, when the first device 300 and the second device 400 that are instructed to perform a specific operation by the third device 500 fail in the authentication, the first device 300 and the second device 400 may notify it by transmitting an error message to the third device 500.

Hereinafter, as an example of the specific operation, a connection operation will be described as an example.

In particular, (a) 1̂ the third device 500 instructs the first device 300 to connect with a counterpart device through the Easy Pairing Service.

2̂ The first device 300 and the second device 400 that are instructed to perform a connection with the counterpart device by the third device 500 may perform a connection procedure with the counterpart device.

However, in the case that the key value generated by the first device 300 and the second device 400 through an encoding algorithm during the pairing/authenticating procedure of the connection procedure is not identical, the connection is failed since the counterpart device is not an authenticated device.

3̂ Accordingly, the first device 300 and the second device 400 transmit an error message including the cause information that represents "Key Mismatching" as the key is not matched.

(b) The third device 500 that receives the error message may notify that the first device 300 and the second device 400 are not connected to a user by outputting detailed cause for the error since the first device 300 is not connected with the counterpart device and the first device 300 and the second device 400 fail in the authentication.

FIG. 18 is a view illustrating another example of a method for outputting an error message proposed in the present disclosure.

Referring to FIG. 18, in the case that the second device 400 is a device that is not allowed to perform the specific operation, the first device 300 that is instructed to perform a specific operation by the third device 500 may notify it by transmitting an error message to the third device 500.

Hereinafter, as an example of the specific operation, a connection operation will be described as an example.

In particular, (a) 1̂ the third device 500 instructs the first device to connect with the second device 400 through the Easy Pairing Service.

2̂ In the case that the first device 300 stores the whitelist that represents the list of the devices that are allowed to connect, the first device 300 checks whether the second device 400 is included in the whitelist.

In the case that the second device 400 is included in the whitelist, the first device 300 may establish a connection with the second device 400, and notify it to the third device.

However, in the case that the second device 400 is not included in the whitelist, the first device 300 is unable to perform the connection procedure with the second device 400 since the second device 400 is a device that is not allowed to connect.

3̂ Accordingly, the first device 300 transmit an error message that includes the causes representing "Not Allowed" to the third device 500 since the second device 400 is a device that is not allowed to connect.

(b) The third device 500 that receives the error message may notify that the first device 300 and the second device 400 are not connected to a user by outputting detailed causes for the error since the second device 400 is a device that is not allowed to connect and fails to connect with the first device 300.

The method proposed in the present specification is described based on the Bluetooth LE, but may also be applied to the Bluetooth BR/EDR.

Further, although the drawings have been individually described for ease of description, the embodiments shown in the drawings may be merged with each other to implement new embodiments. As necessary by one of ordinary skill, designing recording media readably by a computer recording programs to execute the above-described embodiments also belongs to the scope of the present invention.

The elements and the method described in the embodiments are not limitedly applied to the method proposed in the present disclosure, but the whole or a part of each of the embodiments may be selectively constructed so as to form various modifications.

Meanwhile, the method as proposed herein may be implemented as processor-readable codes in a recording medium that may be read by a processor provided in a network device. The process readable recording media include all types of recording devices storing data that is readable by the processor. Examples of the recording media readable by the process include ROMs, RAMs, CD-ROMs, magnetic tapes, floppy discs, optical data storage devices, etc., and may be further implemented in the form of carrier waves such as transmitted over the Internet. Further, the recording media readable by the processor may be distributed to computer systems connected with each other via a network, and processor readable codes may be stored and executed in a distributing manner.

It is apparent to an ordinary skilled person in the art that various modifications and changes may be made without departing from the spirit and scope of the present invention. Accordingly, the present invention is intended to include the modifications and changes of the present invention within the attached claims and the equivalent scope.

And, both of the apparatus invention and the method invention are described in the present disclosure, and both of the invention may be complementarily applied on the occasion demands.

According to the method for controlling a device using the Bluetooth technique according to an embodiment of the present invention, there is an effect that the operation of other device may be controlled through a control device.

In addition, according to the present invention, there is an effect of identifying an error that may occur when a control device controls an operation of a device using the Bluetooth technique.

In addition, according to the present invention, there is an effect that a control device may receive and output the detailed error information that is occurred in a controlled device.

In addition, according to the present invention, there is an effect of decreasing a time consumed to check an error that occurs in a controlled device that is controlled by a control device by decreasing the time consumed to perform an operation of the controlled device instructed by a control device.

The technical effects in the present invention are not limited to the above-described technical effects and other technical effects which are not described herein will become apparent to those skilled in the art from the following description.

What is claimed is:

1. A method for being controlled by a control device performed by a first device using a Bluetooth LE, the method comprising:

establishing a Bluetooth LE connection with the control device;

receiving a write request message requesting a specific operation with the second device from the control device;

transmitting a write response message in response to the request message;

transmitting a request message to the second device in order to perform the specific operation; and transmitting an error message indicating that a performance of the specific operation is failed to the control device, when failing to perform the specific operation with the second device within a specific time, wherein the request message includes time information indicating the specific time.

2. The method of claim 1, wherein the error message includes reason information indicating the cause of the failure of performing the specific operation.

3. The method of claim 2, wherein the reason information indicates one of a failure to receive a response to the request message message, an encryption key mismatch, the first device performing another operation, or the second device not being an acceptable device.

4. The method of claim 1, wherein the specific operation is establishing the Bluetooth LE connection with the second device.

5. The method of claim 1, wherein the step of establishing the Bluetooth LE connection with the control device further comprises, transmitting an advertising message to the control device; and receiving a connection request message for the Bluetooth LE connection from the control device.

6. A method for controlling a first device performed by a control device using a Bluetooth LE, the method comprising:

establishing a Bluetooth LE connection with at least one of the first device or a second device;

receiving a write request message requesting a specific operation with at least one of the first device or the second device;

receiving a write response message in response to the request message;

receiving a message indicating a performance result of the specific operation within a specific time from at least one of the first device or the second device; and outputting the performance result of the specific operation.

7. The method of claim 6, wherein the message further includes reason information indicating a failure reason, when failing to perform the specific operation.

8. The method of claim 7, wherein the step of outputting the performance result includes outputting the failure reason together with the performance result.

9. The method of claim 6, wherein the error reason indicates one of a failure to receive a response to the request message, an encryption key mismatch, performing another operation, or target device not being an acceptable device.

10. A first device being controlled by a control device using a Bluetooth LE, the first device comprising:

a communication unit for communicating with external devices in wireless or wired manner; and a processor functionally connected to the communication unit, wherein the processor is configured to:

establishing a Bluetooth LE connection with the control device;

receiving a write request message requesting a specific operation with a second device from the control device;

transmitting a write response message in response to the request message;

transmitting a request message to the second device in order to perform the specific operation; and transmitting an error message indicating that a performance of the specific operation is failed to the control device, when failing to perform the specific operation with the second device within a specific time, wherein the request message includes time information indicating the specific time.

* * * * *